United States Patent [19]

Reichenberger

[11] Patent Number: 4,597,273

[45] Date of Patent: Jul. 1, 1986

[54] SECURITY DEVICE

[76] Inventor: Arthur M. Reichenberger, 1915 E. Orange Dr., Phoenix, Ariz. 85016

[21] Appl. No.: 609,850

[22] Filed: May 14, 1984

Related U.S. Application Data

[63] Continuation-in-part of Ser. No. 474,446, Mar. 11, 1983, abandoned.

[51] Int. Cl.[4] ..... E05B 73/00

[52] U.S. Cl. ..... 70/30; 70/58; 280/814

[58] Field of Search ..... 70/30, 49, 57, 58, 233, 70/18; 280/814, 820

[56] References Cited

U.S. PATENT DOCUMENTS

| | | | |
|---|---|---|---|
| 1,267,894 | 5/1918 | Olson | 70/30 |
| 1,689,437 | 10/1928 | Hurd | 70/49 X |
| 3,297,333 | 1/1967 | Schwedt et al. | 70/58 X |
| 3,687,472 | 8/1972 | Struble | 280/814 X |
| 3,899,904 | 8/1975 | Brimhall | 70/58 |
| 4,186,576 | 2/1980 | Means et al. | 70/233 |
| 4,267,715 | 5/1981 | Aylesworth | 70/58 |

FOREIGN PATENT DOCUMENTS

| | | | |
|---|---|---|---|
| 628985 | 4/1936 | Fed. Rep. of Germany | 70/30 |
| 1146723 | 3/1969 | United Kingdom | 70/30 |

*Primary Examiner*—Robert L. Wolfe
*Assistant Examiner*—Russell W. Illich

[57] ABSTRACT

A specially adapted grip allowing a lock and folded flexible cable to be stowed inside a standard ski pole. The cable is affixed to the lock and has a looped free end allowing the passage of the lock through the loop after it has been laced through the equipment to be secured. The lock can be latched to any part of the cable after encircling a rack or post.

13 Claims, 13 Drawing Figures

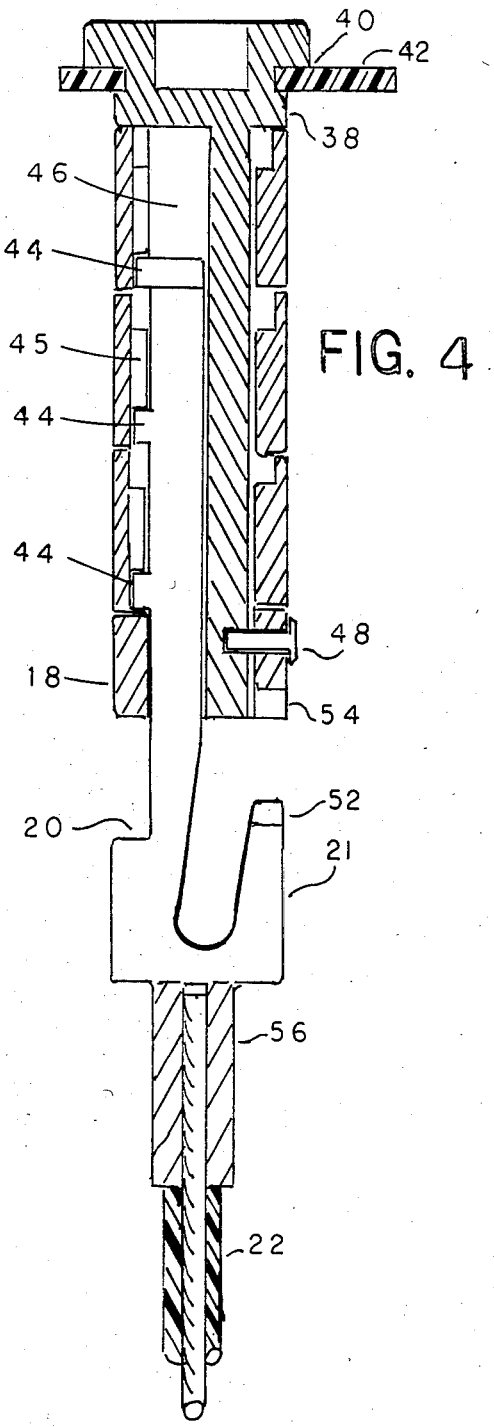
FIG. 4
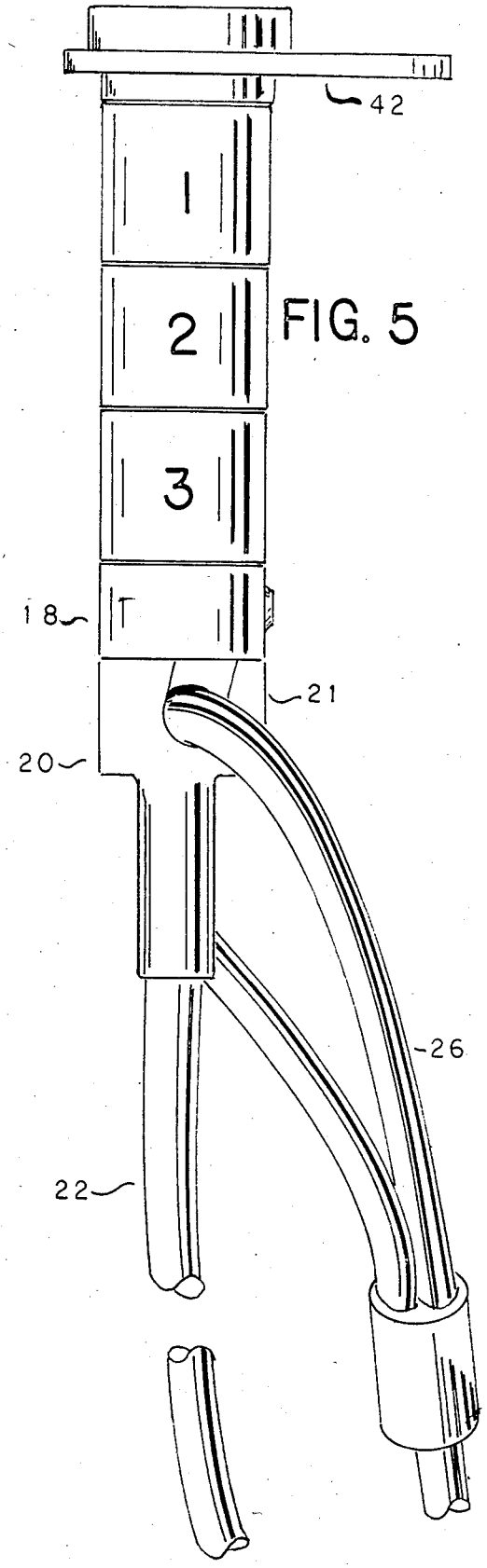
FIG. 5
FIG 13
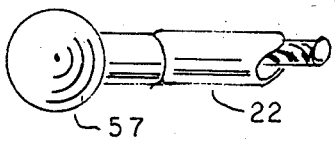

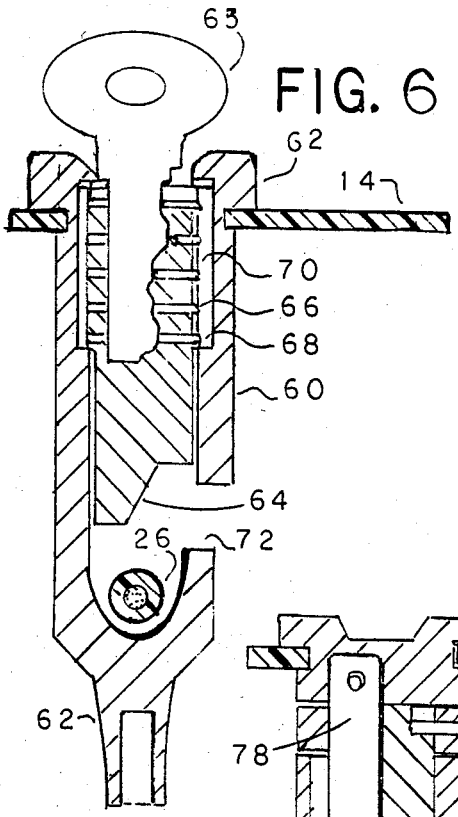
FIG. 6
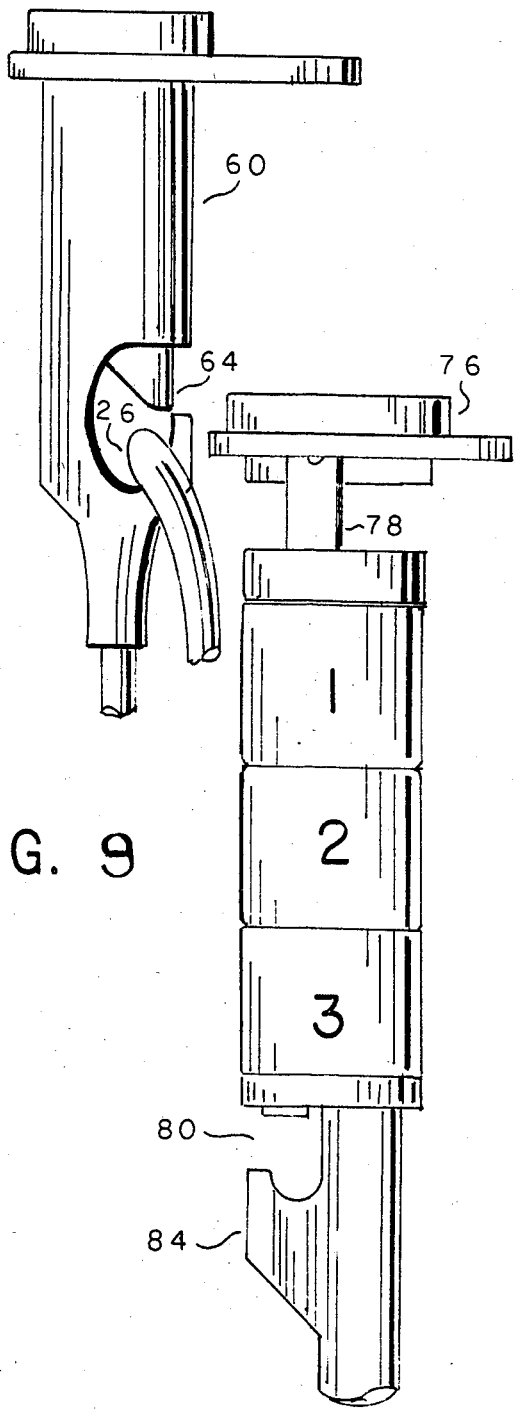
FIG. 7
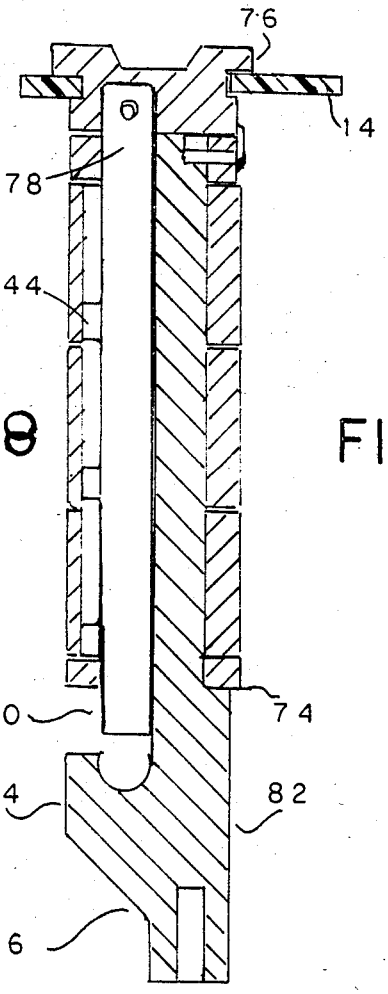
FIG. 8
FIG. 9

SECURITY DEVICE

CROSS REFERENCE TO RELATED APPLICATIONS

This is a continuation-in-part of application Ser. No. 474,446, filed Mar. 11, 1983, now abandoned, and entitled SECURITY DEVICE.

BACKGROUND OF THE INVENTION

1. Field of the Invention

This invention relates to security and thief prevention devices.

More particularly, the present invention relates to a security device for lockably tethering portable property to a relatively immovable support.

In a further and more specific aspect, the instant invention concerns a security device especially adapted for securing an assemblage of ski equipment to a ski rack or the like.

2. Prior Art

The desirability of a security device especially adapted to the needs of skiers is well established. When not actually engaged in the actual physical act of skiing, the skier and his equipment are frequently separated. Usually, such separation places the paraphernalia beyond the attention and eyesight of the owner. Exemplary, is the skier who enters a lodge or other building and mandatorilly leaves his gear outside.

Considering the extreme portability and the substantial value of skis, poles, boots, and related items, ski equipment is a common and favorable target of thieves. It is considered prudent, therefore, for the skier to securably stow his equipment when separation is contemplated. The traditional method of securing ski equipment includes a tether, such as a cable or chain, which is entwined about each item of property and looped about a convenient, relatively immovable object such as a tree or post, and secured with a lock.

The tether and the lock were cumbersome, difficult to stow upon the person, and represented an inconvenience and a hinderence to the skier, especially during the physical maneuvers encountered during the act of skiing. To aleviate the foregoing problem, the prior art has advanced numerous purported solutions.

In general, the proposed prior art devices included lock mechanisms carried by one of the usual pair of ski poles. The lock mechanisms are commonly of the combination type. Also included is a flexible tether, such as a cable, having an end presecured to the pole or the lock mechanism. The free end of the cable is adapted to be secured with the lock mechanism after the cable has been engaged with the several items of personal equipment and looped about a stationary object.

A favored lock mechanism is of a generally cylindrical type having a plurality of axial aligned juxtoposed locking rings. According to certain prior art teachings, the mechanism is incorporated into the shaft of the pole. It is also touted that the lock mechanism comprise a pair of separatable components, one carried by the shaft and the other by the handle.

The tether is usually stored within the hollow tubular shaft of the ski pole. Simply, a portion of the free end of the cable may project through an opening in the side of the ski pole, while an enlargement at the other end, within the shaft, prevents removal. As a variation, the free end of the tether may be affixed to a separable component of the lock mechanism. Alternately, the cable may be carried on a spool, either stored within the shaft or rotatable about the exterior thereof.

Despite profusion, the prior art has not, however, provided an entirely satisfactory solution to the need for a security device especially adapted for skiers. Installing a lock mechanism within a ski pole shaft generally requires extensive modifications, including the removal of a specified length of the shaft. In addition to diminishing structural strength, the procedure requires exacting skills, usually only available from a competent craftsman at additional expense to the skier. Grip mounted lock mechanisms and shaft stowed tethers also demand tools and expertise beyond that of the ordinary skier. A shaft stowed tether, the length of which is limited to the length of the pole below the opening, have a perpensity for perpetuating a distracting rattle within the metalic shaft.

Externally mounted spools, especially devised to accommodate a longer length af cable, are bulky contrivances, are an empediment to the skier, and readily subject to damage as well as being esthetically distractive.

It would be highly advantageous, therefore, to remedy the foregoing and other deficiencies inherent in the prior art.

Accordingly, it is an object of the present invention to provide an improved security device of the type having a lock mechanism and a tether.

Another object of the invention is the provision of a security device especially adapted for use in connection with a conventional tubular apparatus, such as a ski pole, without modification thereof on attachment thereto.

Yet another object of this invention is to provide a lock mechanism with a configuration allowing it to be inserted for stowage inside a normal ski pole.

Still another object of this invention is the provision of a lock mechanism with an attached tether which is stored inside a ski pole in a folded position so that a longer tether can be used.

Yet another object of the invention is to provide a lock mechanism with a combination hasp and securing means for one end of the tether.

A further object of the invention is to provide a cable foldable in the middle with one end secured to the security device and the other end having a loop which can be threaded through the ski equipment and over the securing device allowing the security device to encircle a stationary object and latch to any part of the tether without necessarily returning to be latched to the end of the tether, giving the tether a longer effective length.

Still a further object of the invention is to provide a security device that will fit unobtrusively inside the ski pole and grip with only a flange and flexible pull tab protruding for safety yet easy removal.

And a further object of the invention is the provision of a pole grip with a passageway in the top so the security device and tether can be stored inside any ski pole by replacing the old grip.

A still further object of the invention is to provide a means of carrying skis held together while walking to and from ski area.

Another object of the invention is to provide a means of securing skis and car rack to a vehicle when the rack has no lock.

Another object of the invention is to provide a method of storing the securing tether inside a ski pole in a manner where the natural resilience of the folded tether will hold it against the walls of the ski pole and prevent it from rattling.

SUMMARY OF THE INVENTION

Briefly, to achieve the desired objects of the instant invention, in accordance with the preferred embodiments thereof, provided is a locking mechanism, either keyed or combination, having a hasp or engagement means for receiving a looped end of tethering cable; one end of which is attached to the hasp or housing of the locking mechanism, and having a permanent deflection in the middle to make the tether predisposed to fold. Also provided is a resilient grip, with a passageway through the top, to replace the normal grip and allow insertion of the tether, folded at the middle, and the locking mechanism into the inside of a standard hollow ski pole for stowage when not in use. The housing of the locking mechanism terminates with a flange adjacent an annular recess into which a resilient tab is fitted preventing it from going all the way into the pole. The resilient tab can be gripped with glove clad fingers to remove the lock and attached tether for use. The loop end of the tether can be threaded through apertures of the ski equipment then over the locking mechanism. The lock end of the tether is then looped around a stationary object such as a post or rack and subsequently attached to the tether by the hasp or receiving portion of the locking device.

In one embodiment the locking mechanism includes a housing with annular combination rings encirclingly and rotatably positioned thereon with indicia to indicate rotation of the lock rings to a predetermined aligned position. A core, having a combination hasp and an attached tether slides in a slot of the housing so that hasp is latched at one extreme of the travel and unlatched at the other extreme. The hasp is provided with a plurality of spaced teeth corresponding to the plurality of rotatable annular combination rings. The rings function as detents which allow movement of the hasp only when aligned to a predetermined position. In yet another embodiment, the tether may be attached to the housing.

BRIEF DESCRIPTION OF THE DRAWINGS

The foregoing and further and more specific objects and advantages of the instant invention will become readily apparent to those skilled in the art from following the detailed description of the preferred embodiments thereof taken in conjunction with the drawings in which:

FIG. 4 is a vertical sectional view taken along the line 4—4 of FIG. 1;

FIG. 5 is a side elevation of the combination locking device and tether of FIG. 4 as it would appear with the hasp closed over the loop end of the tether;

FIG. 6 is a vertical sectional view taken along the longitudinal axis of an alternate embodiment of the invention in the form of keyed locking device being illustrated with the latching means in the open position;

FIG. 7 is a side elevation of the alternate locking device of FIG. 6 with the latching means rotated to retain the loop end of the tether;

FIG. 8 is a side elevation of an alternate combination locking device shown with the latching means in an open position;

FIG. 9 is a sectional view taken along the longitudinal axis of the combination locking mechanism of FIG. 8 with spaced teeth positioned in a closed position;

FIG. 13 is a fragmentary elevation view of the free end of the tether showing an alternate embodiment thereof.

DESCRIPTION OF THE PREFERRED EMBODIMENTS

Figure 1:
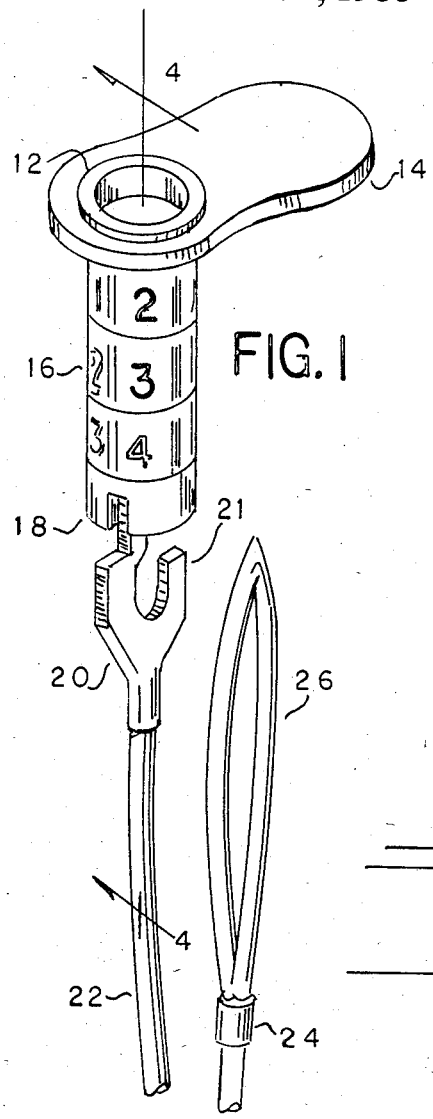
FIG. 1 is a broken perspective view of a locking device with attached tether of the instant invention as it would appear when prepared for insertion through the passageway of the grip of a ski pole.

Turning now to the drawings in which like reference characters indicate corresponding elements throughout the several views, attention is first directed to FIG. 1 which shows a combination locking device generally designated by reference character 10 having a flanged housing 12 over which is snapped a resilient pull tab 14, annular combination rings 16 with indicia for alignment purposes, a retaining end cap 18, a sliding core 20 with a hook portion 21, an attached elongate flexible menber specifically illustrated on cable tether 22 with a swage fitting 24 to form a loop end of the tether 26. The combination locking device will be described in further detail presently.

Figure 2:
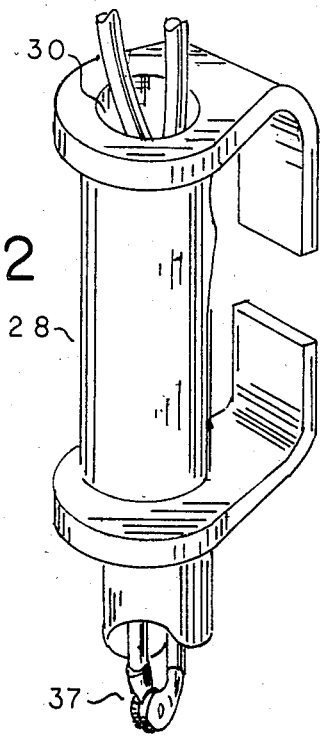
FIG. 2 is a partial perspective view of a ski pole grip with a passageway and a fragmentary portion of a cable tether.

FIG. 2 illustrates a ski pole grip, generally designated by reference character 28, which for purposes of illustration is depicted of the strapless type especially chosen because of the integral appendages which extend around the back of the hand and lack of separate attachment strap. It is anticipated that the grip which is provided with the locking device could be of a design which has a separate strap. Stowage means in the form of passageway 30 is sized to pass locking device 10 and tether 22 through the resilient top portion of grip 28 into the hollow inside of a standard ski pole. The upper portion of passageway 30 is sized to form a slip fit, frictionally engagable receptacle for locking device 10.

In the immediately preferred embodiment, tether 22 has a length which exceeds the length of the ski pole. Accordingly, tether 22 is folded or doubled prior to insertion into passageway 30. To accommodate folding, a predetermined fold point is formed into tether 22. The predetermined fold point may be a crease or kink formed at time of manufacture at a location to divide the tether into two sections, each of which is shorter than the ski pole. Alternately, tether 22 may be fabricated in two sections and joined by a hinge. The inherent tendency of the sections to separate will urge the sections against the interior wall of the ski pole with sufficient tension to prevent rattling, as is better viewed in FIG. 10.

Figure 3:
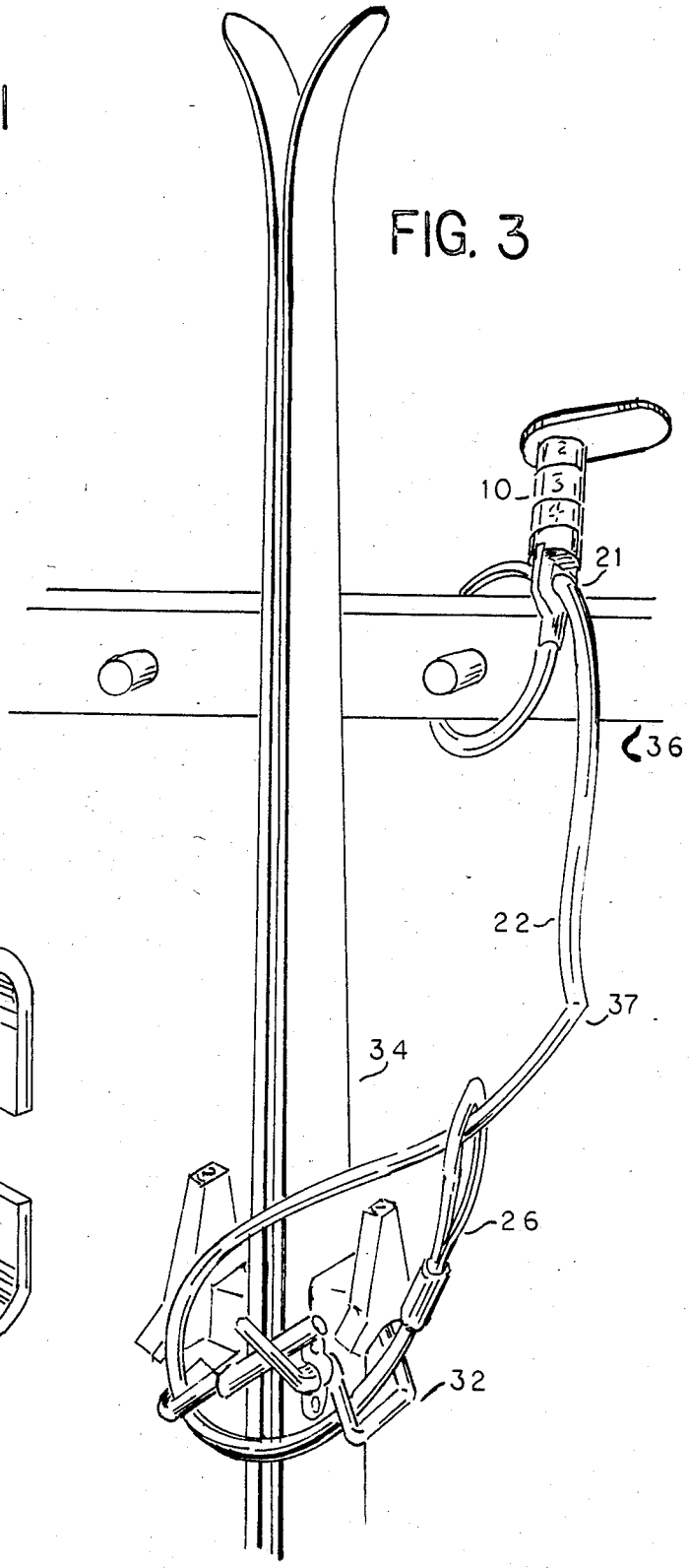
FIG. 3 is a perspective view of the security device showing the tether in the locked position as it would appear in use.

FIG. 3 shows the locking system as it would normally be used to secure skis to a stationary object such as a post or ski rack. Loop end 26 is threaded through openings in brakes 32 of skis 34. Lock 10 is threaded through loop 26, thence around ski rack 36 where hook 21 is closed over tether 22. The predetermined fold point is shown at 37.

As will be appreciated by those skilled in the lock art, the locking mechanism of FIG. 4 is usually referred to as "push type combination lock" where housing 38 has an annular recess 40 into which a resilient pull tab 42 is snapped for removal of locking device from the inside of a ski pole. A plurality of axially aligned teeth 44 of core 20 slide in track 46 of housing 38. End cap 18 is secured to housing 38 by rivet 48 preventing core 20 from escaping the mechanism when in the open or extended position. Annular rings have a passageway 45 to allow the longitudinal movement of core teeth 44 where aligned to the open position depicted but prevent the movement of teeth 44 when not aligned to the open position. The hook 21 of core 20 has a projection 52 which fits into recess 54 of end cap 18 when core 20 isin the retracted or closed position. The tether 22 swaged to the core at 56 is an elongate flexible member such as wire cable encased in a plastic covering.

FIG. 5 shows the core 20 in the retracted or closed position with the tether loop end 26 secured in the hook 21.

From the foregoing description it will be appreciated that housing 38 and hook 21 cooperate as retention means for selectively retaining cable 22. Core 20 is movable between a first or retracted position in which the retention means are closed and a second or extended position in which the means are open. Loop 26 functions as the complementary retention element.

A keyed locking configuration is shown in FIG. 6 in section along its longitudinal axis generally indicated as 60 with its flanged housing 62 over which is snapped a resilient pull tab 14. The key 63 is positioned inside plug 64 holding waifers 66 which can project into longitudinal slots 68 and 70 when they are not aligned by the key 63. The plug 64 extends downward to provide a detent which can cover the passageway 2 when rotated 180° to the locked position by the key 63 yet allow the loop end 26 to pass through the passageway 72 when the key 63 is inserted retracting waifers 66 from slots 68 and 70 and rotated 180° to the unlocked position.

FIG. 7 is a side elevation of the keyed locking device of FIG. 6 with the plug 64 in the latched position over loop end 26 of tether 22.

FIG. 8 is an alternate embodiment of a combination locking device of the instant invention shown in section along its longitudinal axis generally indicated as 74 with its flange 76 attached to slidable core 78 which obstructs passage way 80 when in the closed position shown. Core 78 has axially aligned teeth 44, which slide in track 46 of housing 82. Hook 84 is an integral part of housing 82 with a swage fitting 86 and tether 22.

FIG. 9 is a side elevation of FIG. 8 with the flange 76 and attached core 78 in the retracted position leaving passageway 80 unobstructed so tether 22 can be removed from hook 84.

Figure 10:
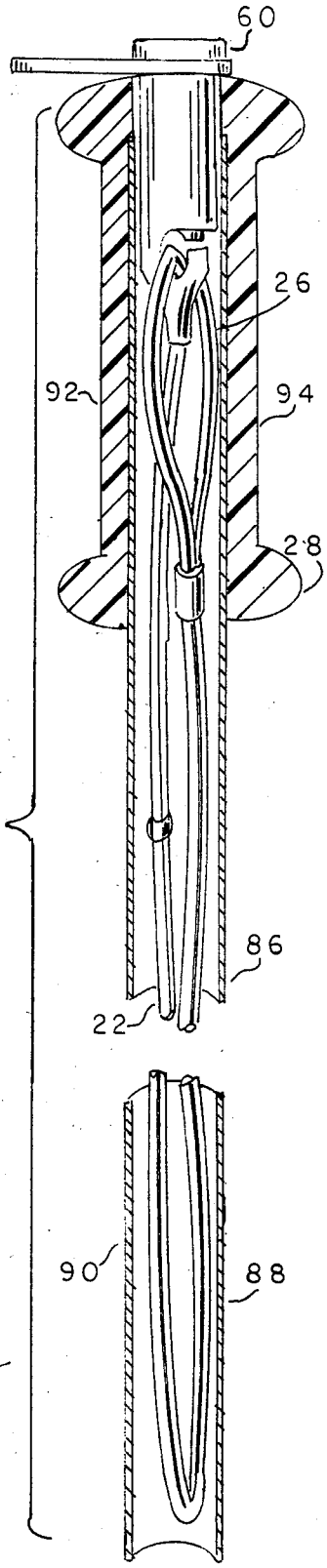
FIG. 10 is a fragmentary side elevation view of a ski pole and grip in longitudinal section and showing the locking device and tether as they would normally be stored inside a hollow ski pole.

FIG. 10 is a sectional view of a ski pole 86 and grip 28 along their vertical axis and showing in elevation locking device 60 and tether 22 folded at the middle with loop end 26 latched in position as they would normally be stowed inside the pole. Because of the natural resilience of the cabled tether it can be seen that it would press against the inside wall of ski pole 86 at points 88, 90, and 94 lessening the tendency to rattle when the ski pole is in use.

It is apparent also that a longer tether can be carried when it is stowed in the folded position.

Figure 11:
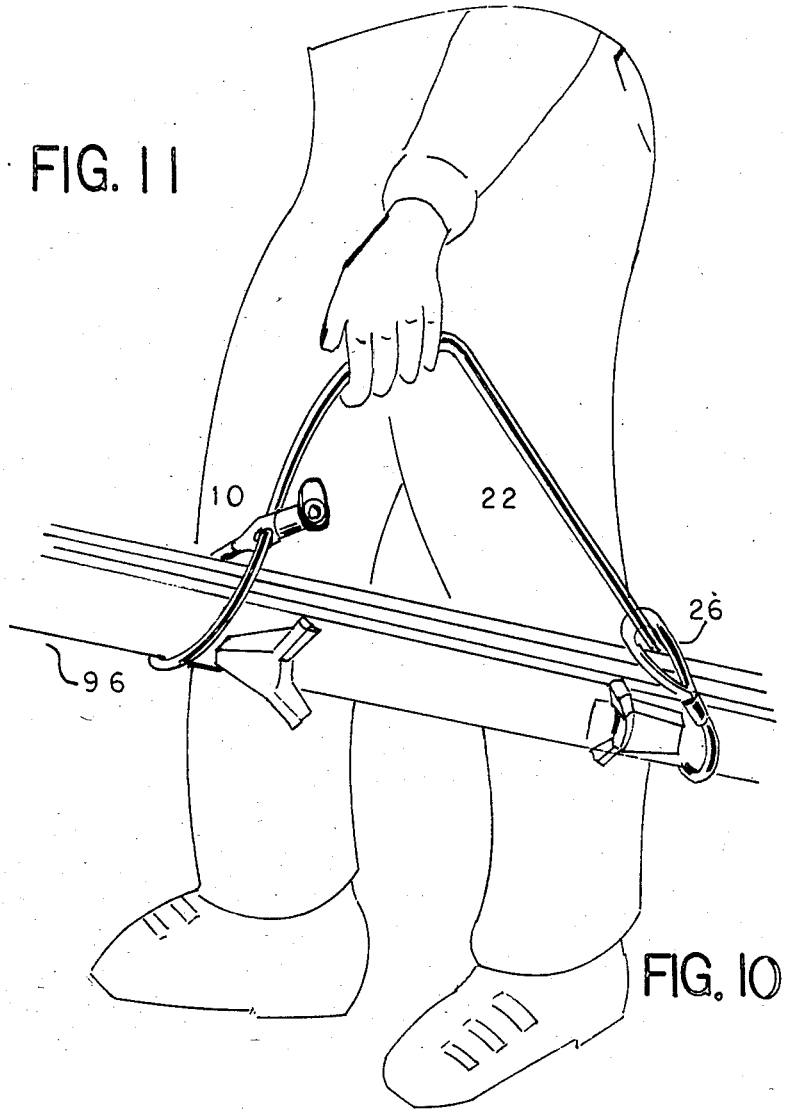
FIG. 11 is a perspective view of a locking system of the instant invention being used as a sling to carry skis.

FIG. 11 is a perspective view of a pair of skis 96 as they would be carried using the tether as a sling with the lock 10 laced through the loop 26 and latched to the tether after including the skis bottom to bottom at 96.

Figure 12:
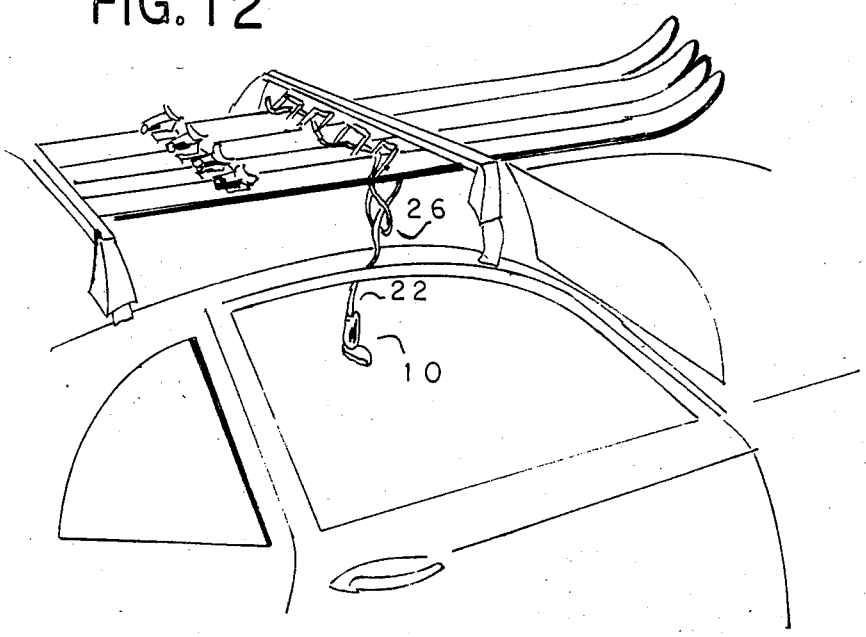
FIG. 12 is a perspective view of the locking system being used to secure skis to a motor vehicle.

FIG. 12 is a perspective view of two pair of skis being locked to a car by threading the loop 26 through the ski bindings and over the lock 10. The door of the car is then closed and locked over the tether 22 with the lock 10 inside the car.

With reference to FIG. 13, there is seen an alternate retention element for the free end of tether 22. An enlargement, specifically illustrated as ball 57 secured to cable 22 in accordance with conventional technique as will be readily understood by those skilled in the art, is sized to prevent passage through the retention means when closed.

Various changes and modifications to the embodiments herein chosen for purposes of illustration will readily occur to those skilled in the art. To the extent that such modifications and variations do not depart from the spirit of the invention, they are intended to be included therein which is assessed only by a fair interpretation of the following claims.

Having full described and disclosed the present invention and alternately preferred embodiments thereof, in such clear and concise terms as to enable those skilled in the art to understand and practice the same, the invention claimed is:

I claim:

1. A security device for lockably tethering ski equipment, which equipment includes a ski pole having a rigid elongate hollow shaft with an open end and having a resilient grip affixed to said shaft and having an end wall normally closing said open end, and for convenient stowage within said equipment when not in use, said security device comprising:

a. a locking device having an end and including
  i. a housing,
  ii. a core disposed within said housing and relatively movable between first and second positions,
  iii. retention means interacting between said housing and said core proximate said end
  said retention means including a passageway formed by a portion of said core and a portion of said housing, said passageway being open in said first position and being closed in said second position, and
  iv. locking means interacting between said housing and said core for selectively retaining said core in said second position b. an elongate flexible member including
  i. a fixed end secured to said locking device proximate the end thereof, and
  ii. a free end;

c. a retention element carried proximate said free end of said flexible member,
  said flexible member being removably receivable within said passageway in said first position
  said retention element preventing removal of said flexible element from said passageway in said second position; and d. stowage means formed in said ski pole for removably receiving said locking device and said flexible member.

2. The security device of claim 1, wherein said stowage means includes:

a. a passageway formed into said grip from the end wall for passage of said flexible member therethrough into said hollow shaft; and b. a receptacle in said passageway proximate said end wall for removably receiving said locking device.

3. The security device of claim 2, wherein said locking device is frictionally engageable within said receptacle.

4. The security device of claim 2, wherein said housing is generally cylindrical and said receptacle is correspondingly shaped.

5. The security device of claim 2, further including stop means for limiting the insertion of said locking device into said receptacle.

6. The security device of claim 5, wherein said stop means includes an enlargement carried by said housing for abutting the end wall of said grip.

7. The security device of claim 5, further including a resilient tab extending radially from said locking device for manually pulling said locking device from said receptacle.

8. The security device of claim 7, wherein said tab normally resides on the external surface of said grip.

9. The security device of claim 1, wherein said retention element includes a closed loop sized to receive said locking device therethrough.

10. The security device of claim 1, wherein said flexible member is affixed to said core.

11. The security device of claim 1, wherein said flexible member is affixed to said housing.

12. The security device of claim 1, wherein said elongate flexible member further includes a predetermined fold point intermediate said ends to facilitate doubling said flexible member prior to said flexible member being received into said stowage means.

13. The security device of claim 12, wherein:

a. said flexible member has a length greater than the length of said ski pole; and b. said fold point resides at a location to divide said flexible member into first and second sections each said section having a length shorter than the length of said ski pole.

* * * * *